US009653017B2

(12) United States Patent
Guo et al.

(10) Patent No.: US 9,653,017 B2
(45) Date of Patent: May 16, 2017

(54) PIXEL STRUCTURE, DRIVING METHOD THEREOF AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN); Peng Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/102,082

(22) PCT Filed: Dec. 11, 2015

(86) PCT No.: PCT/CN2015/097115
§ 371 (c)(1),
(2) Date: Jun. 6, 2016

(87) PCT Pub. No.: WO2016/161815
PCT Pub. Date: Oct. 13, 2016

(65) Prior Publication Data

US 2017/0069252 A1 Mar. 9, 2017

(30) Foreign Application Priority Data

Apr. 9, 2015 (CN) ..... 2015 1 0166850

(51) Int. Cl.
*G09G 3/20* (2006.01)

(52) U.S. Cl.
CPC ..... *G09G 3/2092* (2013.01); *G09G 3/2003* (2013.01); *G09G 3/2074* (2013.01);
(Continued)

(58) Field of Classification Search
None
See application file for complete search history.

(56) References Cited

U.S. PATENT DOCUMENTS 5,235,447 A * 8/1993 Hepp ..... G09G 3/3607 349/109
8,860,642 B2 * 10/2014 Phan ..... G09G 3/20 345/589

(Continued)

FOREIGN PATENT DOCUMENTS

CN 1738501 A 2/2006
CN 101290410 A 10/2008

(Continued)

OTHER PUBLICATIONS

Search Report and Written Opinion Mailed Mar. 17, 2016 from State Intellectual Property Office of the P.R. China.

(Continued)

*Primary Examiner* — Antonio Xavier
(74) *Attorney, Agent, or Firm* — Dilworth & Barrese, LLP.; Michael J. Musella

(57) ABSTRACT

A pixel structure, a driving method thereof and a display device are provided. The pixel structure includes a plurality of closely arranged repeating groups, and each of the repeating groups includes linearly arranged square pixel units of different colors. Each of the square pixel units in each of the repeating groups is formed by two sub-pixels with a same color and a same shape; and two sub-pixels in adjacent square pixel units have different arrangement modes. The repeating groups disposed on two adjacent parallel straight (Continued)

lines are staggered by a distance of one and a half square pixel units. With such a pixel structure, input information is subjected to brightness redistribution and intensively outputted to the actual physical positions, the optional switching of the sub-pixels can be applied on the premise of not reducing the pixel size, and hence the resolution of the display image can be improved.

20 Claims, 7 Drawing Sheets

(52) U.S. Cl.
CPC ..... *G09G 2300/0452* (2013.01); *G09G 2320/0646* (2013.01)

(56) References Cited

U.S. PATENT DOCUMENTS

2005/0018110 A1 1/2005 Liu
2006/0033422 A1 2/2006 Chao et al.
2007/0024183 A1 2/2007 Lih et al.
2007/0146242 A1* 6/2007 Miller ..... G09G 3/2074 345/76
2008/0001536 A1 1/2008 Tsai et al.
2008/0231554 A1 9/2008 Lee
2009/0213036 A1 8/2009 Hara
2009/0219225 A1* 9/2009 Cope ..... G09F 9/30 345/55
2009/0251556 A1* 10/2009 Mabuchi ..... H01L 27/14621 348/222.1
2009/0262100 A1* 10/2009 Su ..... G09G 3/3607 345/209
2014/0319486 A1* 10/2014 Hong ..... G09G 3/32 257/40
2015/0015466 A1* 1/2015 Feng ..... G09G 3/2003 345/77
2015/0116615 A1* 4/2015 Seo ..... G02F 1/136286 349/37
2015/0144893 A1* 5/2015 Chen ..... H05B 33/0896 257/40

FOREIGN PATENT DOCUMENTS

CN 102201430 A 9/2011
CN 102354702 A 2/2012
CN 203085546 U 7/2013
CN 203134285 U 8/2013
CN 103366683 A 10/2013
CN 103745684 A 4/2014
CN 104332486 A 2/2015
CN 104732928 A 6/2015
EP 2333760 A2 6/2011
JP 200918600 A 8/2009
JP 2013058323 A 3/2013
KR 1020120014510 A 2/2012

OTHER PUBLICATIONS

Chinese Office Action from Chinese Application 201510166850.3 dated Sep. 5, 2016 with English translation.
Second Office Action issued by Chinese Patent Office dated Jan. 22, 2017.

* cited by examiner $$\overset{R}{\begin{pmatrix} 0 & 0.2 & 0 \\ 0 & 0.6 & 0 \\ 0 & 0.2 & 0 \end{pmatrix}} \quad \overset{G}{\begin{pmatrix} 0 & 0.2 & 0 \\ 0 & 0.6 & 0 \\ 0 & 0.2 & 0 \end{pmatrix}} \quad \overset{B}{\begin{pmatrix} 0 & 0.2 & 0 \\ 0 & 0.6 & 0 \\ 0 & 0.2 & 0 \end{pmatrix}}$$

FIG. 3a $$\overset{R}{\begin{pmatrix} 0 & 0.1 & 0 \\ 0 & 0.8 & 0 \\ 0 & 0.1 & 0 \end{pmatrix}} \quad \overset{G}{\begin{pmatrix} 0 & 0.1 & 0 \\ 0 & 0.8 & 0 \\ 0 & 0.1 & 0 \end{pmatrix}} \quad \overset{B}{\begin{pmatrix} 0 & 0.1 & 0 \\ 0 & 0.8 & 0 \\ 0 & 0.1 & 0 \end{pmatrix}}$$

FIG. 3b $$\overset{R}{\begin{pmatrix} 0 & 0.2 & 0 \\ -0.1 & 0.8 & -0.1 \\ 0 & 0.2 & 0 \end{pmatrix}} \quad \overset{G}{\begin{pmatrix} 0 & 0.2 & 0 \\ -0.1 & 0.8 & -0.1 \\ 0 & 0.2 & 0 \end{pmatrix}} \quad \overset{B}{\begin{pmatrix} 0 & 0.2 & 0 \\ -0.1 & 0.8 & -0.1 \\ 0 & 0.2 & 0 \end{pmatrix}}$$

FIG. 3c $$R = \begin{pmatrix} -0.05 & 0.2 & -0.05 \\ 0 & 0.8 & 0 \\ -0.05 & 0.2 & -0.05 \end{pmatrix} \quad G = \begin{pmatrix} -0.05 & 0.2 & -0.05 \\ 0 & 0.8 & 0 \\ -0.05 & 0.2 & -0.05 \end{pmatrix} \quad B = \begin{pmatrix} -0.05 & 0.2 & -0.05 \\ 0 & 0.8 & 0 \\ -0.05 & 0.2 & -0.05 \end{pmatrix}$$

PIXEL STRUCTURE, DRIVING METHOD THEREOF AND DISPLAY DEVICE

TECHNICAL FIELD

Embodiments of the present invention relate to a pixel structure, a driving method thereof and a display device.

BACKGROUND

Currently, the normal pixel design of displays is RGB or RGBW design, namely three or four sub-pixels are combined into a pixel for display, and the visual resolution is the physical resolution. However, along with higher requirement on the experience of customers on the displays, panel manufacturers need to continuously increase the visual resolution (PPI) of the displays. Currently, the means of reducing the pixel size is usually adopted to improve the physical resolution of the displays. However, when the pixel size is smaller and smaller, the manufacturing process of the displays is more and more difficult. Particularly in the process of manufacturing organic light-emitting diode (OLED) displays, the process of patterning organic matters is very difficult, so there is bottleneck in the process of manufacturing displays with higher physical resolution.

SUMMARY

An embodiment of the invention provides a pixel structure, comprising: a plurality of closely arranged repeating groups, wherein each of the repeating groups includes linearly arranged square pixel units of different colors; each of the square pixel units in each of the repeating groups is formed by two sub-pixels with a same color and a same shape; two sub-pixels in adjacent square pixel units have different arrangement modes; and the repeating groups disposed on two adjacent parallel straight lines are staggered by a distance of one and a half square pixel units.

Another embodiment of the invention provides a display device comprising the above mentioned pixel structure.

Still another embodiment of the invention provides a method for driving the above mentioned pixel structure.

BRIEF DESCRIPTION OF THE DRAWINGS

Brief description will be given below to the accompanying drawings of the embodiments to provide a more clear understanding of the technical proposals of the embodiments of the present invention. Obviously, the drawings described below only involve some embodiments of the present invention but are not intended to limit the present invention.

FIGS. 3*a* to 3*d* are respectively schematic diagrams illustrating the brightness distribution ratio of pixels in the embodiment of the present invention;

FIG. 4 is a schematic diagram of a white pixel input signal in the embodiment of the present invention;

FIG. 8 is a schematic diagram of the pixel structure provided by the embodiment of the present invention for displaying an oblique line of white pixels in.

DETAILED DESCRIPTION

For more clear understanding of the objectives, technical proposals and advantages of the embodiments of the present invention, clear and complete description will be given below to the technical proposals of the embodiments of the present invention with reference to the accompanying drawings of the embodiments of the present invention. Obviously, the preferred embodiments are only partial embodiments of the present invention but not all the embodiments. All the other embodiments obtained by those skilled in the art without creative efforts on the basis of the embodiments of the present invention illustrated shall fall within the scope of protection of the present invention.

Detailed description will be given below to the preferred embodiments of the pixel structure, the driving method thereof and the display device, provided by the embodiment of the present invention, with reference to the accompanying drawings.

Figure 1:
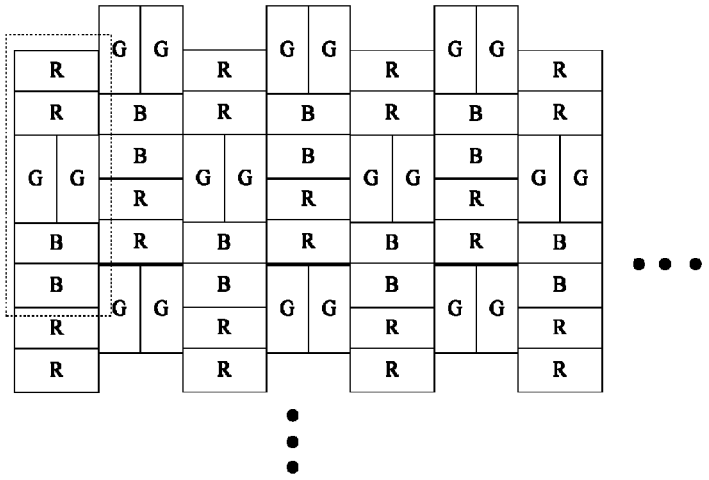
FIG. 1 is a schematic structural view 1 of a pixel structure provided by the embodiment of the present invention.
Figure 2:
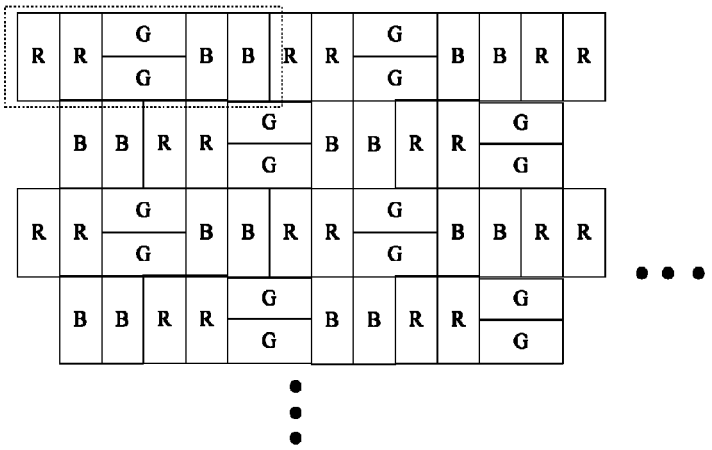
FIG. 2 is a schematic structural view 2 of the pixel structure provided by the embodiment of the present invention.

The embodiment of the present invention provides a pixel structure, which, as illustrated in FIGS. 1 and 2, may comprise: a plurality of closely arranged repeating groups (those marked by dashed boxes in FIGS. 1 and 2). The repeating group is formed by linearly arranged RGB square pixel units; each square pixel unit in the repeating group is formed by two sub-pixels with a same color and a same shape; two sub-pixels in adjacent square pixel units have different arrangement modes; and the repeating groups disposed on two adjacent parallel straight lines are staggered by the distance of one and a half square pixel units.

In the embodiment, the repeating groups are formed by RGB square pixel units, but the embodiment of the present invention is not limited thereto, for instance, may further comprise square pixel units of other colors.

For instance, the case that the two sub-pixels in the adjacent square pixel units have different arrangement modes refers to that the two sub-pixels have different arrangement directions. For instance, the two sub-pixels may be arranged along the row direction or the column direction.

The pixel structure provided by the embodiment of the present invention comprises a plurality of closely arranged repeating groups; the repeating group is formed by linearly arranged RGB square pixel units; each square pixel unit in the repeating group is formed by two sub-pixels; two sub-pixels with same color and same shape in adjacent square pixel units have different arrangement modes; the repeating groups disposed on two adjacent parallel straight lines are staggered by the distance of one and a half square pixel units; and the pixel structure with the abnormal pixel arrangement is adopted to cooperate with virtual computing to achieve virtual display. That is to say, information is inputted correspondingly according to actual physical positions, and the input information is subjected to brightness redistribution and intensively outputted to the actual physical positions. For instance, when an image signal of displaying a white pixel is received, all the sub-pixels or three adjacent RGB sub-pixels in three adjacent RGB square pixel units, distributed in the shape of a delta at the position of a square pixel unit for displaying the white pixel, in the pixel structure are controlled to be switched on to display the white pixel, so that the optional switching of the sub-pixels can be flexibly applied on the premise of not reducing the pixel size, and hence the output resolution of the display image can be improved.

The pixel structure provided by the embodiment of the present invention may be arranged in the mode as illustrated in FIG. 1. That is to say, the RGB square pixel units in the repeating groups are arranged in the column direction, and the repeating groups in adjacent columns is staggered by the distance of one and a half square pixel units in the column direction. Moreover, in the repeating group, two sub-pixels in the first square pixel unit and the third square pixel unit are arranged in parallel in the row direction, and two sub-pixels in the second square pixel unit are arranged in parallel in the column direction. Thus, the pixels of three colors, namely RGB, may be uniformly and dispersedly arranged in physical spaces. In the case of image display, image signals are inputted correspondingly according to the arrangement of physical pixels, and input information is subjected to brightness redistribution and intensively outputted to the positions of actual physical pixels for virtual display output, so that the visual resolution of display images can be improved on the premise of not reducing the pixel size.

Figures 3D, 4:
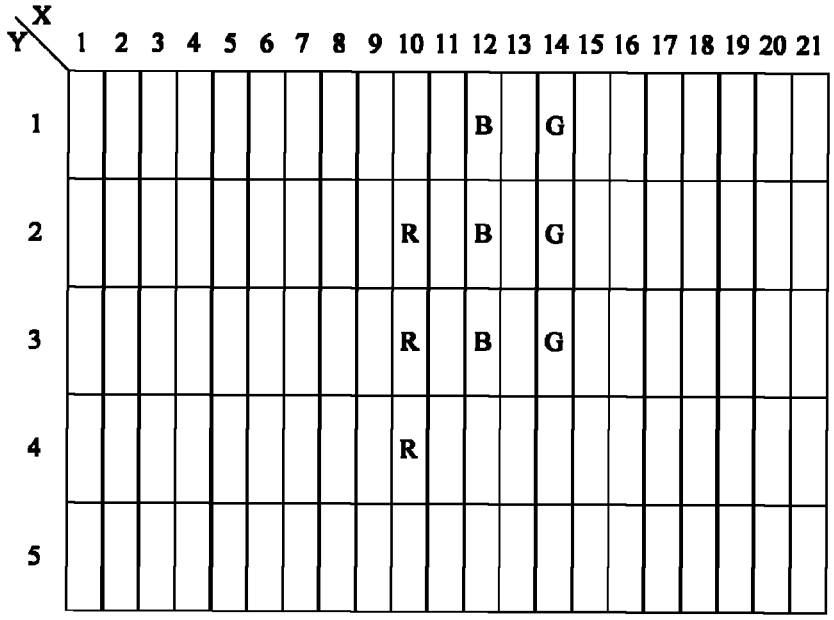

For instance, when image display is achieved by the pixel structure provided by the embodiment of the present invention, actual output signals are obtained by the brightness ratio calculation of corresponding input information, and the distribution of brightness outputted corresponding to the actual physical pixels may be as illustrated in FIG. 3*a*. For instance, the distribution of brightness of R sub-pixels outputted corresponding to the actual physical pixels is the brightness of 60% in the middle and the brightness of 20% on the top and at the bottom respectively, so that the actual output brightness can be obtained by overall brightness superposition. Of course, the brightness may also be distributed according to other ratios, as illustrated in FIGS. 3*b* to 3*d*. No limitation will be given here.

For instance, in the pixel structure provided by the embodiment of the present invention, as illustrated in FIG. 2, the RGB square pixel units in the repeating groups are arranged in the row direction, and the repeating groups in adjacent rows is staggered by the distance of one and a half square pixel units in the row direction. Moreover, in the repeating group, two sub-pixels in the first square pixel unit and the third square pixel unit are arranged in the row direction and disposed in parallel to each other, and two sub-pixels in the second square pixel unit are arranged in the column direction and disposed in parallel to each other. Thus, the sub-pixels of three colors, namely RGB, may also be uniformly and dispersedly arranged in physical spaces by adoption of the pixel arrangement mode. In the case of image display, image signals are inputted correspondingly according to the arrangement of physical pixels, and input information is subjected to brightness redistribution and intensively outputted to the positions of actual physical pixels for virtual display output, so that the visual resolution of display images can be improved on the premise of not reducing the pixel size. In the case of image display, the means of obtaining the actual output signals by the brightness ratio calculation of the input information is the same with that of the pixel structure in which the RGB square pixel units in the repeating groups are arranged in the column direction. No further description will be given here.

For instance, a pixel string is formed by a plurality of repeating groups in the arrangement direction of the square pixel units of different colors in the repeating group; a plurality of pixel strings are set to be parallel to each other in respective extension directions; and two adjacent repeating groups respectively disposed in adjacent pixel strings are overlapped in the direction perpendicular to the extension direction of the pixel string, and the overlapping length is half of the length of the repeating group in the arrangement direction of the square pixel units of different colors. As illustrated in FIG. 1, the arrangement direction of the square pixel units of different colors in the repeating group may be the column direction. As illustrated in FIG. 2, the arrangement direction of the square pixel units of different colors in the repeating group may be the row direction. But the embodiment of the present invention is not limited thereto.

For instance, the square pixel units of different colors have the same shape and size.

For instance, in each square pixel unit, the sub-pixel is rectangular. But the embodiment of the present invention is not limited thereto.

The embodiment of the present invention provides a display device, which comprises the pixel structure provided by the embodiment of the present invention. The display device may be any product or component with display function such as a mobile phone, a tablet PC, a TV, a display, a notebook computer, a digital picture frame and a navigator. As the principle of solving problems of the display device is similar to that of the pixel structure, the embodiments of the display device may refer to the embodiments of the pixel structure. No further description will be given here.

The embodiment of the present invention provides a method for driving the pixel structure provided by the embodiment of the present invention, which comprises: controlling all the sub-pixels or three adjacent RGB sub-pixels in three adjacent RGB square pixel units, distributed in the shape of a delta at the position of a square pixel unit for displaying a white pixel, in the pixel structure to switch on when receiving an image signal of displaying at least one white pixel.

Figure 5A:
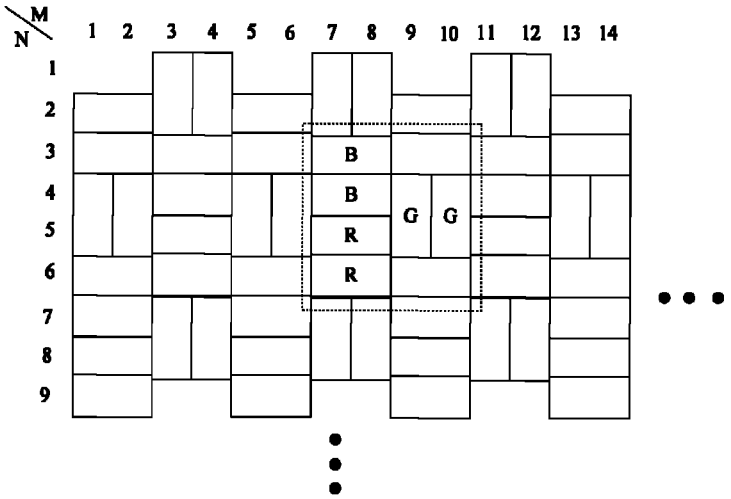
FIGS. 5*a* and 5*b* are respectively schematic diagrams of the pixel structure provided by the embodiment of the present invention for displaying a white pixel.
Figure 5B:
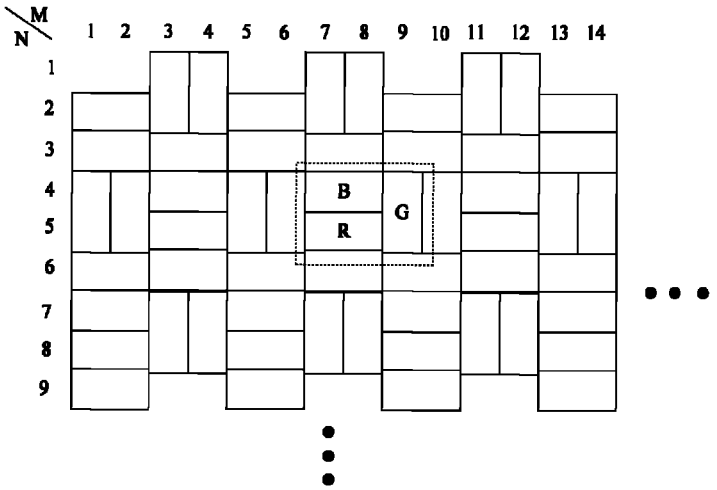

For instance, in the driving method provided by the embodiment of the present invention, when a corresponding input signal of displaying one white pixel, as illustrated in FIG. 4, is received, the corresponding positions of actual output physical pixels in the pixel structure provided by the embodiment of the present invention may be as shown in FIG. 5*a* or 5*b*. As illustrated in FIG. 5*a*, the brightness of pixels M7N3 and M7N4 which actually output blue corresponding to input signals is outputted by the distribution of X12Y1, X12Y2 and X12Y3 in FIG. 4 according to certain brightness ratio. Similarly, the brightness of red pixels M7N5 and M7N6 is outputted by the distribution of X10Y2, X10Y3 and X10Y4 in FIG. 4 according to certain brightness ratio, and the brightness of green pixels M9N4 and M10N4 is outputted by the distribution of X14Y1, X14Y2 and X14Y3 in FIG. 4 according to certain brightness ratio. As illustrated in FIG. 5*b*, when a signal of displaying a white pixel is received, only three adjacent RGB sub-pixels in three adjacent RGB square pixel units distributed in the shape of a delta may also be switched on, namely the inputted image signals are shared. In the case of the actual output of the red sub-pixel M7N5 in FIG. 5*b*, the inputted image signals are X10Y2, X10Y3 and X10Y4 in FIG. 4, wherein the pixel X10Y3 is the main information output position, the brightness distribution of which is primary, and the brightness distribution of the other two pixel positions X10Y2 and X10Y4 is secondary. Similarly, the signal input and actual output of the blue sub-pixel M7N4 and the green sub-pixel M9N4 is in accordance with the same distribution mode. No detailed description will be given here. The combined output means can output signals within the smallest physical space, so that virtual display can be achieved, and hence the output resolution can be improved.

For instance, in the driving method provided by the embodiment of the present invention, when an image signal of displaying one row of white pixels is received, partial sub-pixels in square pixel units at the positions of square pixel units for displaying one row of white pixels in the pixel structure, in which the RGB square pixel units in the repeating groups are arranged in the column direction, are controlled to be switched on, so that the switched-on sub-pixels can only occupy the positions of two rows of sub-pixels.

Figure 6:
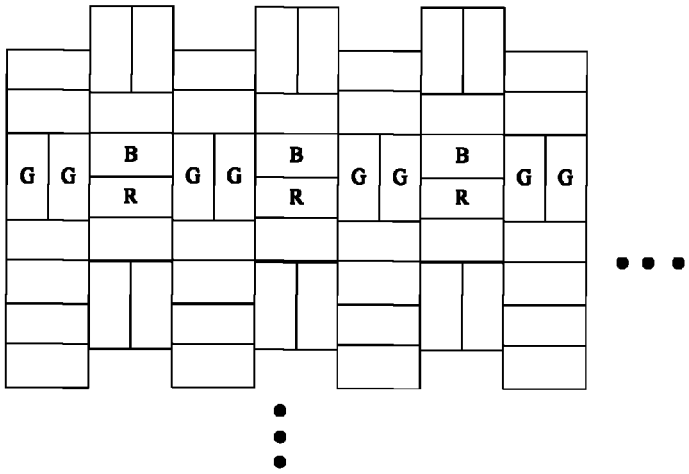
FIG. 6 is a schematic diagram of the pixel structure provided by the embodiment of the present invention for displaying one row of white pixels.

For instance, in the driving method provided by the embodiment of the present invention, when an image signal of displaying one row of white pixels is received, as illustrated in FIG. 6, two sub-pixels in each square pixel unit are respectively controlled and only sub-pixels required for switching are switched on and sub-pixels not required for switching are switched off, so that finally switched-on sub-pixels can indicate the highest resolution on a horizontal line. Thus, clear image output can be achieved, and hence the virtual resolution of images can be higher.

For instance, in the driving method provided by the embodiment of the present invention, when an image signal of displaying one column of white pixels is received, partial sub-pixels in square pixel units at the positions of square pixel units for displaying one column of white pixels in the pixel structure, in which the RGB square pixel units in the repeating groups are arranged in the row direction, are controlled to be switched on, so that the switched-on sub-pixels can only occupy the positions of two columns of sub-pixels.

Figure 7:
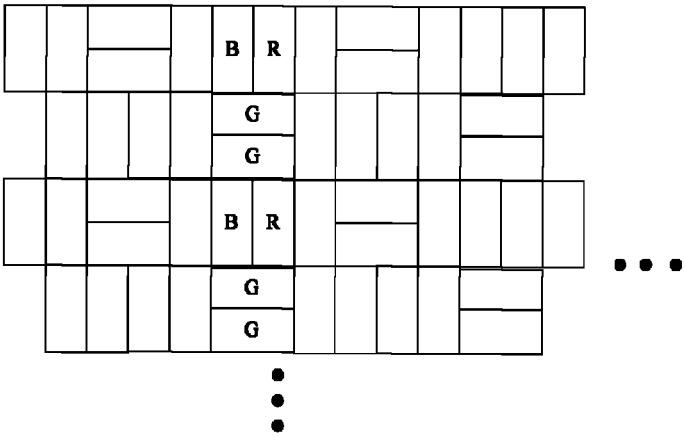
FIG. 7 is a schematic diagram of the pixel structure provided by the embodiment of the present invention for displaying one column of white pixels.

For instance, in the driving method provided by the embodiment of the present invention, when an image signal of displaying one column of white pixels is received, as illustrated in FIG. 7, two sub-pixels in each square pixel unit are respectively controlled and only sub-pixels required for switching are switched on and sub-pixels not required for switching are switched off, so that finally switched-on sub-pixels can indicate the highest resolution on a vertical line. Thus, clear image output can be achieved, and hence the virtual resolution of images can be higher.

For instance, in the driving method provided by the embodiment of the present invention, when an image signal of displaying oblique line of white pixels is received, partial sub-pixels in square pixel units at the positions of square pixel units for displaying the oblique line of white pixels in the pixel structure are controlled to be switched on, so that the switched-on sub-pixels are connected into an image of the oblique line of white pixels.

Figure 8:
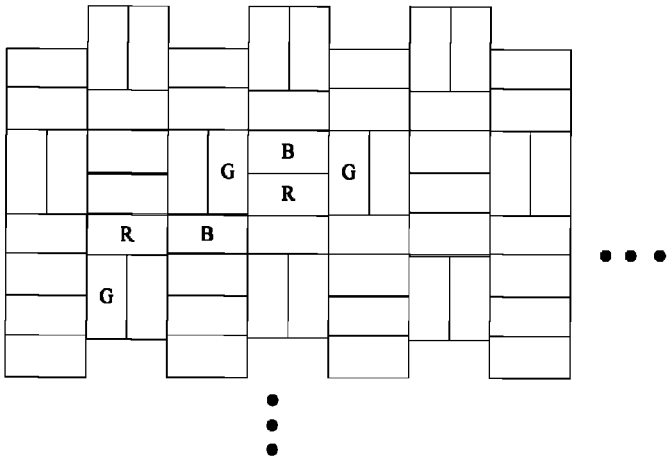

For instance, in the driving method provided by the embodiment of the present invention, when an image signal of displaying oblique line of white pixels is received, as illustrated in FIG. 8, two sub-pixels in each square pixel unit corresponding to the image signal of displaying the oblique line of white pixels are respectively controlled, and only sub-pixels required for switching are switched on and sub-pixels not required for switching are switched off, so that finally switched-on sub-pixels can be switched on along a borderline of an oblique line image. Thus, clear image output can be achieved, and hence the virtual resolution of the image can be higher.

For instance, in the driving method provided by the embodiment of the present invention, when an image signal of displaying at least one monochromatic pixel is received, all the sub-pixels or any one sub-pixel in square pixel units at the positions of square pixel units for displaying the monochromatic pixels in the pixel structure are controlled to be switched on.

Figure 9A:
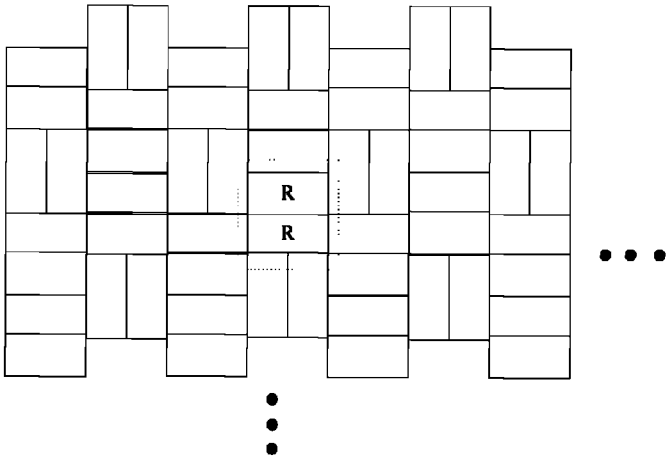
FIGS. 9*a* to 9*c* are respectively schematic diagrams of the pixel structure provided by the embodiment of the present invention for displaying red pixels.
Figure 9B:
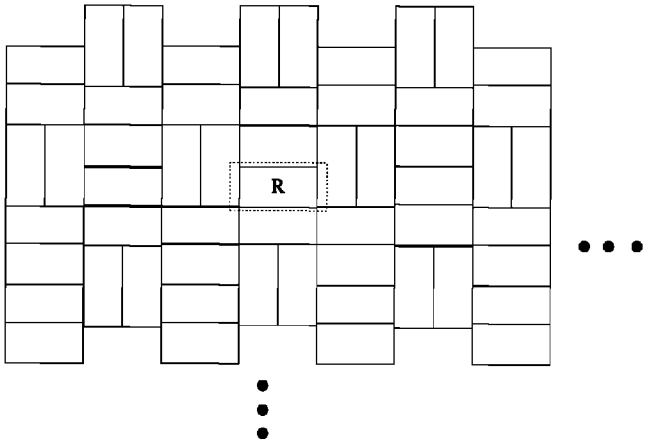
Figure 9C:
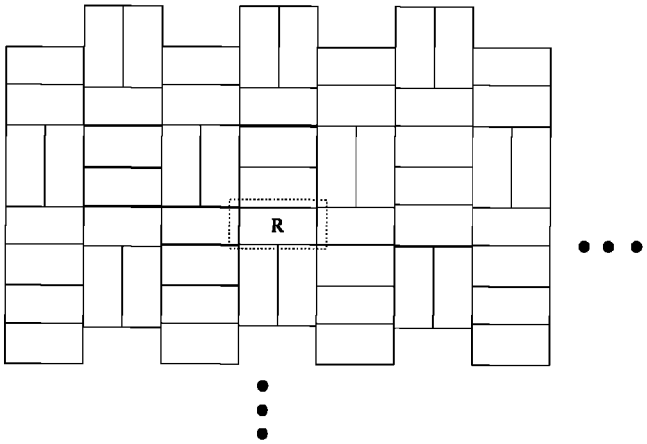

For instance, in the driving method provided by the embodiment of the present invention, when an image signal of displaying monochromatic pixels, e.g., red pixels, is received, as illustrated in FIG. 9*a*, two red sub-pixels in a corresponding square pixel unit for displaying the red pixel are switched on simultaneously, so that a continuous image can be displayed; or as illustrated in FIGS. 9*b* and 9*c*, any one red sub-pixel in a corresponding square pixel unit for displaying the red pixel is switched on, so that the single sub-pixel can be flexibly switched on, and hence the details of fine pictures can be displayed.

Embodiments of the present invention provide a pixel structure, a driving method thereof and a display device. The pixel structure comprises: a plurality of closely arranged repeating groups; the repeating group is formed by linearly arranged RGB square pixel units; each square pixel unit in the repeating group is formed by two sub-pixels with same color and same shape; two sub-pixels in adjacent square pixel units have different arrangement modes; the repeating groups disposed on two adjacent parallel straight lines are staggered by the distance of one and a half square pixel units; and the pixel structure with the abnormal pixel arrangement is adopted to cooperate with virtual computing to achieve virtual display. That is to say, information is inputted correspondingly according to actual physical positions, and the input information is subjected to brightness redistribution and intensively outputted to the actual physical positions. For instance, when an image signal of displaying a white pixel is received, all the sub-pixels or three adjacent RGB sub-pixels in three adjacent RGB square pixel units, distributed in the shape of a delta at the position of a square pixel unit for displaying the white pixel, in the pixel structure are controlled to be switched on to display the white pixel, so that the optional switching of the sub-pixels can be flexibly applied on the premise of not reducing the pixel size, and hence the output resolution of the display image can be improved.

The foregoing is only the preferred embodiments of the present invention and not intended to limit the scope of protection of the present invention. The scope of protection of the present invention should be defined by the appended claims.

The application claims priority to the Chinese patent application No. 201510166850.3, filed Apr. 9, 2015, the disclosure of which is incorporated herein by reference as part of the application.

The invention claimed is:

1. A pixel structure, comprising: a plurality of closely arranged repeating groups, wherein each of the repeating groups includes linearly arranged square pixel units of different colors; each of the square pixel units in each of the repeating groups is formed by two sub-pixels with a same color and a same shape; wherein the two sub-pixels of a pixel unit are both arranged along the row direction or the column direction; two sub-pixels in adjacent square pixel units in the same repeating group have different arrangement directions; and the square pixel units of the same color disposed on two adjacent parallel straight lines are separated by a distance of a half square pixel unit along an extending direction of the parallel straight lines.

2. The pixel structure according to claim 1, wherein a pixel string is formed by a plurality of repeating groups in an arrangement direction of the square pixel units of different colors in the repeating groups; a plurality of pixel strings are set to be parallel to each other in respective extension directions; and two adjacent repeating groups respectively disposed in adjacent pixel strings are overlapped in a direction perpendicular to the extension direction of the pixel string, and an overlapping length is half of a length of each of the repeating groups in the arrangement direction of the square pixel units of different colors.

3. The pixel structure according to claim 2, wherein the square pixel units of different colors in each of the repeating groups are arranged along a column direction; and the square pixel units of the same color in adjacent columns are separated by the distance of a half square pixel unit in the column direction.

4. The pixel structure according to claim 1, wherein the square pixel units of different colors in each of the repeating groups are arranged along a column direction; and the square pixel units of the same color in adjacent columns are separated by the distance of a half square pixel unit in the column direction.

5. The pixel structure according to claim 4, wherein in each of the repeating groups, two sub-pixels in a first square pixel unit and a third square pixel unit are arranged in the column direction, and two sub-pixels in a second square pixel unit are arranged in a row direction.

6. The pixel structure according to claim 1, wherein the square pixel units of different colors in each of the repeating groups are arranged along a row direction; and the square pixel units of the same color in adjacent rows are separated by the distance of a half square pixel unit in the row direction.

7. The pixel structure according to claim 6, wherein in each of the repeating groups, two sub-pixels in a first square pixel unit and a third square pixel unit are arranged in the row direction, and two sub-pixels in a second square pixel unit are arranged in the column direction.

8. The pixel structure according to claim 1, wherein the square pixel units of different colors include red square pixel units, green square pixel units and blue square pixel units.

9. A display device, comprising the pixel structure according to claim 1.

10. The display device according to claim 9, wherein a pixel string is formed by a plurality of repeating groups in an arrangement direction of the square pixel units of different colors in the repeating groups; a plurality of pixel strings are set to be parallel to each other in respective extension directions; and two adjacent repeating groups respectively disposed in adjacent pixel strings are overlapped in a direction perpendicular to the extension direction of the pixel string, and an overlapping length is half of a length of each of the repeating groups in the arrangement direction of the square pixel units of different colors.

11. The display device according to claim 9, wherein the square pixel units of different colors in each of the repeating groups are arranged along a column direction; and the square pixel units of the same color in adjacent columns are separated by the distance of a half square pixel unit in the column direction.

12. The display device according to claim 11, wherein in each of the repeating groups, two sub-pixels in a first square pixel unit and a third square pixel unit are arranged in the column direction, and two sub-pixels in a second square pixel unit are arranged in a row direction.

13. The display device according to claim 9, wherein the square pixel units of different colors in each of the repeating groups are arranged along a row direction; and the square pixel units of the same color in adjacent rows are separated by the distance of a half square pixel unit in the row direction.

14. The display device according to claim 13, wherein in each of the repeating groups, two sub-pixels in a first square pixel unit and a third square pixel unit are arranged in the row direction, and two sub-pixels in a second square pixel unit are arranged in the column direction.

15. The display device according to claim 9, wherein the square pixel units of different colors include red square pixel units, green square pixel units and blue square pixel units.

16. A method for driving the pixel structure according to claim 1, comprising:

upon an image signal of displaying at least one white pixel being received, controlling all the sub-pixels or three adjacent sub-pixels of different colors in three adjacent square pixel units of different colors, distributed in a shape of a delta at a position of square pixel units for displaying the white pixel, in the pixel structure to be switched on.

17. The method according to claim 16, wherein upon an image signal of displaying one row of white pixels being received, partial sub-pixels in square pixel units at positions of square pixel units for displaying one row of white pixels in the pixel structure, in which the square pixel units of different colors in the repeating groups are arranged in the column direction, are controlled to be switched on, so that the switched-on sub-pixels only occupy positions of two rows of sub-pixels.

18. The method according to claim 16, wherein upon an image signal of displaying one column of white pixels being received, partial sub-pixels in square pixel units at positions of square pixel units for displaying one column of white pixels in the pixel structure, in which the square pixel units of different colors in the repeating groups are arranged in the row direction, are controlled to be switched on, so that the switched-on sub-pixels only occupy positions of two columns of sub-pixels.

19. The method according to claim 16, wherein upon an image signal of displaying an oblique line of white pixels being received, partial sub-pixels in square pixel units at positions of square pixel units for displaying the oblique line of white pixels in the pixel structure are controlled to be switched on, so that the switched-on sub-pixels are connected into an image of the oblique line of white pixels.

20. The method according to claim 16, wherein upon an image signal of displaying at least one monochromatic pixel being received, all the sub-pixels or any one sub-pixel in each of the square pixel units at positions of square pixel units for displaying the monochromatic pixels in the pixel structure are controlled to be switched on.

* * * * *